US005245767A

United States Patent [19]

Morin

[11] Patent Number: 5,245,767

[45] Date of Patent: Sep. 21, 1993

[54] RUBBER BOOT FOR THE CONSTRUCTION INDUSTRY

[76] Inventor: Lewis J. Morin, 742 Garvey Rd., SW., Palm Bay, Fla. 32905

[21] Appl. No.: 510,723

[22] Filed: Apr. 18, 1990

[51] Int. Cl.[5] ..... A43B 3/00; A43B 23/00

[52] U.S. Cl. ..... 36/136; 36/1; 36/113

[58] Field of Search ..... 36/4, 136, 1, 113, 83, 36/132

[56] References Cited

U.S. PATENT DOCUMENTS

| | | | |
|---|---|---|---|
| 36,381 | 9/1862 | Willard | 36/136 |
| 262,594 | 8/1882 | How | 36/136 |
| 1,289,391 | 12/1918 | Wirsching | 36/1 |
| 2,728,999 | 1/1956 | L'Horvier | 36/4 |
| 2,908,982 | 10/1959 | Corley | 36/4 |
| 4,034,424 | 8/1977 | Crain | 36/113 |

FOREIGN PATENT DOCUMENTS

| | | | |
|---|---|---|---|
| 581825 | 11/1955 | Canada | 36/136 |
| 480708 | 9/1916 | France | 36/136 |
| 23122 | of 1912 | United Kingdom | 36/136 |
| 231690 | 4/1925 | United Kingdom | 36/4 |

*Primary Examiner*—Steven N. Meyers

*Attorney, Agent, or Firm*—Evenson, Wands, Edwards, Lenahan & McKeown

[57] ABSTRACT

A concrete worker's below-the-knee boot is provided with a pocket and a flap to prevent concrete-covered tools from contacting the worker's leg skin and to keep the tools handy. The pocket is open at the top and bottom to permit easy insertion of a tool and to allow concrete on the tool to drain off. The flap can be folded out above the boot where the tool is longer than the boot.

3 Claims, 1 Drawing Sheet

RUBBER BOOT FOR THE CONSTRUCTION INDUSTRY

BACKGROUND AND SUMMARY OF THE INVENTION

The present invention relates to an improved boot construction, and, more particularly to a boot construction which has particular use by concrete workers in the construction industry.

It is the present custom for concrete layers to wear rubber boots. The worker uses a tool known as a float so that while the concrete is being poured, the float is used to float around plumming or against walls, or wherever the concrete needs to be flat, smooth or slick. The float is a very important tool in the concrete trade.

Unfortunately, however, the worker usually has no place to carry the float at the worksite when he or she is engaged in pouring and raking out the concrete. The float is either put down somewhere where it can be lost or damaged or, as is also commonly done, the worker puts the float down inside his rubber boot between the inside of the boot and his leg. I have recognized that this custom exposes the worker's leg to the caustic lime material contained in the concrete.

Although it has been known to use footwear with closed pockets for things such as sport shoes for carrying car keys or change as shown in U.S. Pat. Nos. 654,388; 1,289,341; and 4,638,579, the prior art does not contain a boot acceptable for use with concrete work which will prevent caustic material from contacting a worker's leg.

It is therefore an object of the present invention to overcome the problems and disadvantages encountered in the past by concrete workers in connection with the storage and carrying of floats.

It is yet another object of the present invention to provide an inexpensive and expedient device which conveniently stores a concrete worker's float on the worker so as to be conveniently retrievable without in anyway hindering the movements of the worker.

The foregoing objects have been achieved in accordance with the present invention by providing a below-the-knee rubber boot which has a pocket piece made of vinyl or rubber attached to the outside surface of the boot by bonding, gluing, welding, strapping or the like to prevent any caustic material in the concrete from contacting the worker's leg. Alternatively, the pocket can be molded directly to the boot. Furthermore, the bottom of the pocket can be left open so that liquid gritty concrete material on the float which is usually about 16 inches long can drip off through the opening by gravity and back into the concrete where it can be reworked with a concrete trowel. The top of the pocket is also opened and, therefore, readily accessible so that the worker would be encouraged to store the float in the boot rather than to lay it down somewhere where it can be lost or damaged. A flap can be arranged at the top of the boot in the event the float is of such length to extend above the top of the boot.

The present invention has the advantage of keeping the float handy for the concrete worker when he or she is working on big open areas of concrete or in areas where lots of plumbing has been installed.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE DRAWINGS

Figure 2:
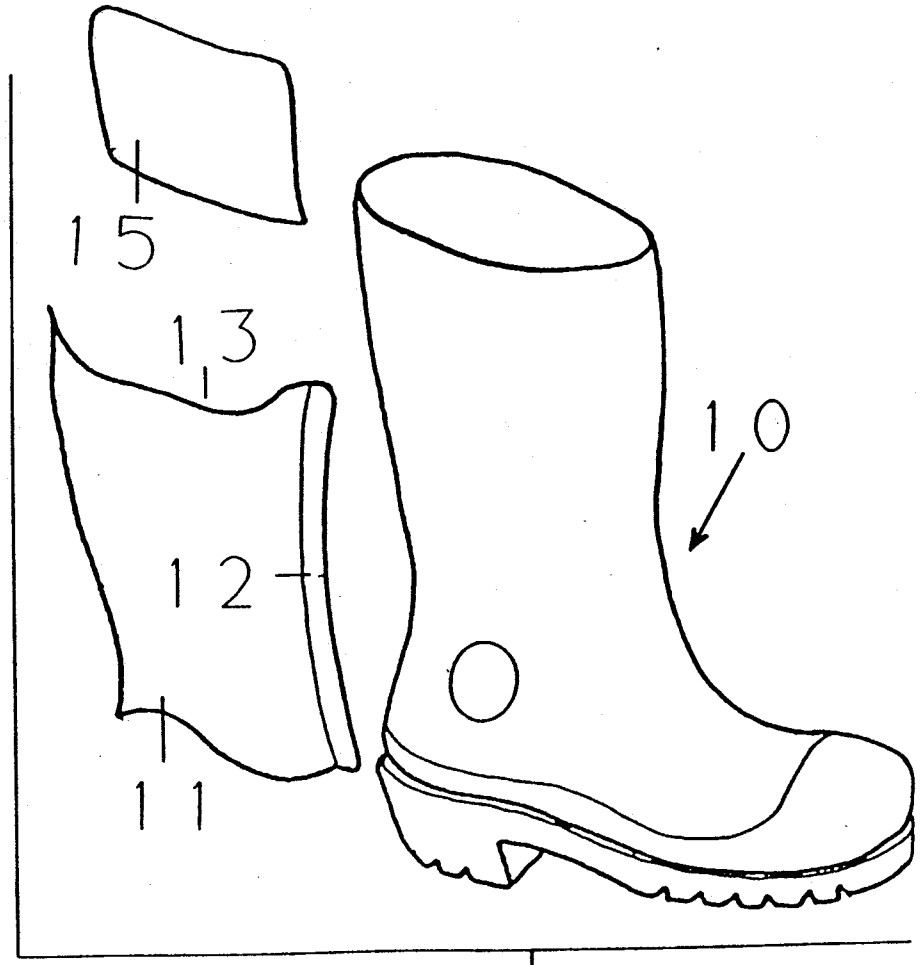
FIG. 2 is an expoded perspective view of the boot of FIG. 1 with the pocket and flap separated from the boot.

Referring to the drawings, there is shown a boot of the type typically worn by a cement worker and designated by the numeral 10. Normally, this would be a below-the-knee boot made of rubber or neoprene which can be washed off after use by means of a hose. The boot is of standard construction and, by itself, forms no part of the present invention.

Figure 1:
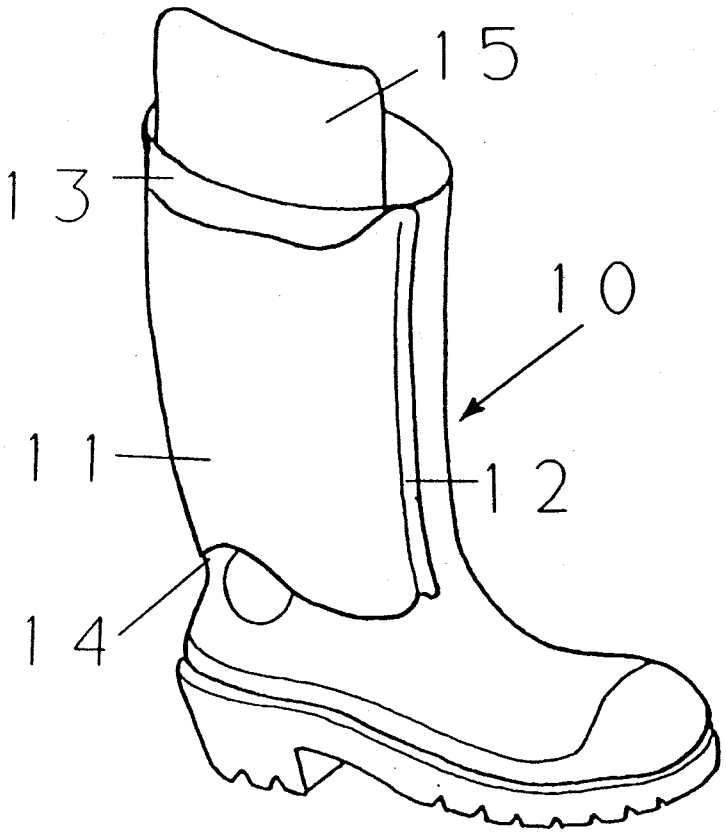
FIG. 1 is a view of the assembled boot in accordance with the present invention.

Attached to the boot 10 is a pocket 11 which is, broadly speaking, U-shaped having a flange 12 on each side (only one of which is shown in the drawings) for attachment to the side of the boot 10 by bonding, gluing, ultrasonic welding, rivetting or by any other suitable connection, including molding. The U-shape of the pocket 11 defines openings 13 and 14 at the top and bottom, respectively, of the pocket 11. As will be seen in FIG. 1, the opening 13 at the top of the pocket 11 is level with the top of the boot 10. The opening 14 at the bottom of the pocket 11 permits the liquid, gritty cementatious material to drain off the tool (not shown) which can be inserted through the top 13 of the pocket 11 for handy access when the concrete worker needs to use the float or other similar tool.

Since the typical float used in construction and cement work is about 16 inches long, a flap 15 can also be molded, glued, welded, rivetted or otherwise joined at the top opening of the boot 10 so that the float containing caustic material will not come in contact with the worker's clothes or skin and cause irritation or other problems. The flap is made of material having sufficient rigidity so as to remain upright, but can be folded inside the top 13 of the pocket 11 when a tool is not in the pocket or when a tool is of such a length as to fit entirely within the pocket 11.

While I have shown and described alternative embodiments in accordance with my invention, it is to be understood that the same is susceptible to other changes and modifications without departing from the scope of my invention. Therefore, I do not intend to be limited to details shown and described herein but intend to cover any changes and modifications as are encompassed by the scope of the intended claims.

I claim:

1. A footwear article of manufacture for use by a wearer in the presence of a substance such as concrete and the like, comprising a below-the-knee boot and a generally continuous unitary piece of material, which is generally impervious to the caustic effects of said substance, and is configured as a U-shaped open pocket attached along side portions thereof to an outside leg portion of the boot, said U-shaped open pocket being open at top and bottom portions thereof, so as to form a generally tubular-like passageway therethrough from top to bottom, and thereby allow the insertion of a tool for working with said substance from the top, whereby the inserted tool may be retained therein along said outside leg portion of the boot, while allowing said substance, that may be present on the tool when the tool is inserted into the open top portion of said pocket, to drop away through the open bottom portion of said pocket, wherein said unitary piece of material extends from the top portion of the boot to an ankle region of the boot.

2. A footwear article of manufacture according to claim 1, wherein said flap is foldable into the top open portion of said pocket.

3. A footwear article of manufacture for use by a wearer in the presence of a substance such as concrete and the like, comprising a below-the-knee boot and a generally continuous unitary piece of material, which is generally impervious to the caustic effects of said substance, and is configured as a U-shaped open pocket attached along side portions thereof to an outside leg portion of the boot, said U-shaped open pocket being open at top and bottom portions thereof, so as to form a generally tubular-like passageway therethrough from top to bottom, and thereby allow the insertion of a tool for working with said substance from the top, whereby the inserted tool may be retained therein along said outside leg portion of the boot, while allowing said substance, that may be present on the tool when the tool is inserted into the open top portion of said pocket, to drop away through the open bottom portion of said pocket, further including a flap of material which is generally impervious to the caustic effects of said substance, and has sufficient rigidity to remain upright, extending upwardly from the open top portion of said pocket and above a top portion of the boot, and thereby preventing said substance that may be present on a portio of work tool that extends above the top portion of the boot from coming into contact with a wearer's skin or clothes.

* * * * *